United States Patent [19]

Hiraga et al.

[11] 4,453,899

[45] Jun. 12, 1984

[54] SCROLL TYPE FLUID DISPLACEMENT APPARATUS WITH REINFORCED WRAP SEALS

[75] Inventors: Masaharu Hiraga, Honjyo; Tadao Kogima; Nobuaki Saegusa, both of Isesaki, all of Japan

[73] Assignee: Sanden Corporation, Japan

[21] Appl. No.: 267,456

[22] Filed: May 27, 1981

[30] Foreign Application Priority Data

May 31, 1980 [JP] Japan ..... 55-74643[U]
Aug. 13, 1980 [JP] Japan ..... 55-115455[U]

[51] Int. Cl.[3] ..... F01C 1/02; F01C 19/08

[52] U.S. Cl. ..... 418/55; 418/142; 277/188 R; 277/204; 277/235 R; 277/235 A

[58] Field of Search ..... 418/55, 142, 178; 277/235 A, DIG. 6, 204, 235 R, 188 R

[56] References Cited

U.S. PATENT DOCUMENTS

| | | | |
|---|---|---|---|
| 2,807,511 | 9/1957 | Fleming | 277/DIG. 6 |
| 2,887,331 | 5/1959 | Johnson | 277/DIG. 6 |
| 3,986,799 | 10/1976 | McCullough | 418/55 |
| 3,994,633 | 11/1976 | Shaffer | 418/55 |
| 3,994,635 | 11/1976 | McCullough | 418/55 |
| 3,994,636 | 11/1976 | McCullough et al. | 418/55 |
| 4,065,279 | 12/1977 | McCullough | 418/55 |
| 4,199,308 | 4/1980 | McCullough | 418/55 |
| 4,212,472 | 7/1980 | Mizuno et al. | 277/DIG. 6 |
| 4,221,390 | 9/1980 | Bainbridge | 277/DIG. 6 |
| 4,345,886 | 8/1982 | Nakayama et al. | 418/142 |

FOREIGN PATENT DOCUMENTS

| | | | |
|---|---|---|---|
| 1218822 | 6/1966 | Fed. Rep. of Germany | 418/178 |
| 2402558 | 7/1975 | Fed. Rep. of Germany | 418/178 |

*Primary Examiner*—John J. Vrablik
*Attorney, Agent, or Firm*—Banner, Birch, McKie & Beckett

[57] ABSTRACT

A scroll type fluid displacement apparatus having an orbiting scroll member and a fixed scroll member which form at least one pair of sealed off fluid pockets therebetween for fluid compression. The axial end surface of the spiral element of the scroll member has a groove along the spiral curve. A seal element is loosely fitted in the groove and has a reinforcement member for preventing localized bending thereof. During operation, the pressurized fluid flows into the groove to urge the seal element against the opposite end plate, so that the axial sealing between the spiral element and end plates is effected, and localized wear of the seal element by changes in the fluid pressure is prevented by the rigidifying reinforcement member.

19 Claims, 15 Drawing Figures

SCROLL TYPE FLUID DISPLACEMENT APPARATUS WITH REINFORCED WRAP SEALS

BACKGROUND OF THE INVENTION

This invention relates to a fluid displacement apparatus, and more particularly, to a fluid displacement apparatus of the scroll type.

Scroll type apparatus are well known in the prior art. For example, U.S. Pat. No. 801,182 discloses a device including two scroll members each having a circular end plate and a spiroidal or involute spiral element. These scroll members are maintained angularly and radially offset so that both spiral elements interfit to make a plurality of line contacts between their spiral curved surfaces, thereby to seal off and define at least one pair of fluid pockets. The relative orbital motion of the two scroll members shifts the line contact along the spiral curved surfaces and, therefore, the fluid pockets change in volume. The volume of the fluid pockets increases or decreases dependent on the direction of the orbiting motion. Therefore, the scroll type apparatus is applicable to compress, expand or pump fluids.

In comparison with conventional compressors of the piston type, the scroll type compressor has certain advantages, such as fewer parts and continuous compression of fluid. However, there have been several problems, primarily the sealing of the fluid pockets. Sealing of the fluid pockets must be sufficiently maintained in a scroll type fluid displacement apparatus, because the fluid pockets are defined by the line contacts between the interfitting spiral elements and axial contacts between the axial end surfaces of the spiral elements and the inner surfaces of the end plates.

One solution to the sealing problem, in particular, that relating to axial sealing, is described in U.S. Pat. No. 3,874,827. This patent discloses the concept of non-rotatably supporting the fixed scroll member within the compressor housing in an axially floating condition. A high pressure fluid is introduced behind the fixed scroll member to establish sufficient axial sealing. In this arrangement, since the fixed scroll member is supported in an axially floating condition, the fixed scroll member may wobble due to the eccentric orbital motion of the orbiting scroll member. Therefore, sealing and resultant fluid compression tends to be imperfectly performed.

In order to avoid these disadvantages, the pressure of the high pressure fluid introduced must be increased, and the clearance between radial supporting parts must be made as small as possible. However, costly close tolerances of the working parts is required to minimize this clearance, while an increase of the pressure of the introduced fluid results in increased contact pressure between both scroll members, which increases mechanical loss or may damage them.

Another method for improving the axial seal of the fluid pockets is to use seal elements which are mounted in the axial end surface of each of the spiral elements, as disclosed in U.S. Pat. No. 3,994,635. In this arrangement, the end surface of each spiral element facing the end plate of the other scroll member is provided with a groove formed along the spiral. A seal element is placed within each of the grooves. An axial force urging means in each groove, such as a spring, urges the seal toward the facing end surface of the end plate to thereby effect axial sealing. In this arrangement, the construction for the axial force urging means for the seal is complex, and it is difficult to obtain the desired uniform sealing force along the length of the seal element.

In order to avoid these disadvantages, the seal element is loosely fitted into the groove formed in the axial end surface of each spiral element, and the pressurized fluid is introduced into the groove from adjacent fluid pockets to urge the seal element towards the facing end plate, as a substitute for mechanical urging means, to thereby effect axial sealing. However, the seal element is subject to localized excessive wear during a portion of the orbital motion of the orbiting scroll member. That is, during the period when the pair of fluid pockets are both connected to the central high pressure space, localized fluid pressure behind the seal element is suddenly enlarged, resulting in excessive sealing force which sometimes induces localized bending of the seal element and excessive sealing force.

SUMMARY OF THE INVENTION

It is a primary object of this invention to provide an efficient scroll type fluid displacement apparatus.

It is another object of this invention to provide a scroll type fluid displacement apparatus wherein the axial sealing of the fluid pockets is insured and concentrated wear of the seal elements is prevented.

It is still another object of this invention to accomplish the above objects with a simple construction, a simple production method, and low cost.

A scroll type fluid displacement apparatus according to this invention includes a pair of scroll members each comprising an end plate and a spiral wrap means extending from one side of the end plate. The spiral is provided with a groove which is formed in the axial end surface thereof and extends along the spiral curve of the wrap means. A seal element is loosely fitted in the groove, and has a reinforcement member for preventing the localized bending thereof. During operation, the pressurized fluid flows from adjacent fluid pockets which are formed between the interfitting scroll members into the groove to urge the seal element into contact with the opposite end plate means, without localized bending thereof.

In one aspect of this invention, the seal element comprises a sliding member and a core member for the reinforcement member. The core member is formed of a metal having a high rigidity, such as steel, and the sliding member is formed of a material which has a high sealing efficiency with low friction coefficient, such as polytetrafluoroethylene (PTFE) resin. Hence, when the fluid pressure behind the seal element is changed, the localized bending of the seal element is prevented by the core member.

In another aspect of this invention, the seal element is disposed within a channel-shaped guide member. The axial end surface of the seal element extends from the opening portion of the guide member. Therefore, sufficient rigidity of the seal element is afforded by the guide member. Integral springy protrusions formed on the bottom wall of the guide member urge the seal element into sealing engagement with the end plate.

The following detailed description of a preferred embodiment of the invention relates to a fluid displacement apparatus of the compressor type. The principles of the invention are equally applicable to other types of fluid displacement apparatus.

DETAILED DESCRIPTION OF THE PREFERRED EMBODIMENT

Before the preferred embodiment of this invention will be described, the principle of operation of the scroll type compressor unit will be described with reference to FIGS. 1*a*–1*d*. The scroll type compressor unit operates by moving sealed off fluid pockets from a low pressure region to a high pressure region.

Figure 1A:
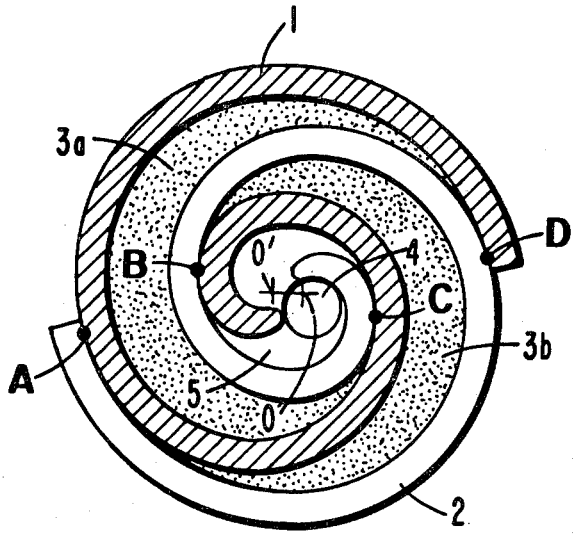
FIGS. 1*a*–1*d* are views illustrating the principle of the operation of a scroll type compressor.

FIGS. 1*a*–1*d* may be considered to be end views of a compressor wherein the end plates are removed and only spiral elements are shown. Two spiral elements 1 and 2 are angularly offset and interfit with one another. As shown in FIG. 1*a*, the orbiting spiral element 1 and fixed spiral element 2 make four line contacts due to the radial offset of one spiral as shown at four points A–D. A pair of fluid pockets 3*a* and 3*b* are defined between line contacts D, C and line contacts A, B, as shown by the dotted regions. The fluid pockets 3*a* and 3*b* are defined not only by the walls of spiral elements 1 and 2, but also by the end plates from which these spiral elements extend. When orbiting spiral element 1 is moved in relation to fixed spiral element 2 so that the center 0' of orbiting spiral element 1 revolves around the center 0 of fixed spiral element 2 with a radius of 0—0' while the rotation of orbiting spiral element 1 is prevented, a pair of fluid pockets 3*a* and 3*b* shift angularly and radially toward the center of the interfitted spiral elements with the volume of each fluid pocket 3*a* and 3*b* being gradually reduced, as shown in FIGS. 1*a*–1*d*. Therefore, the fluid in each pocket is compressed.

Figure 1B:
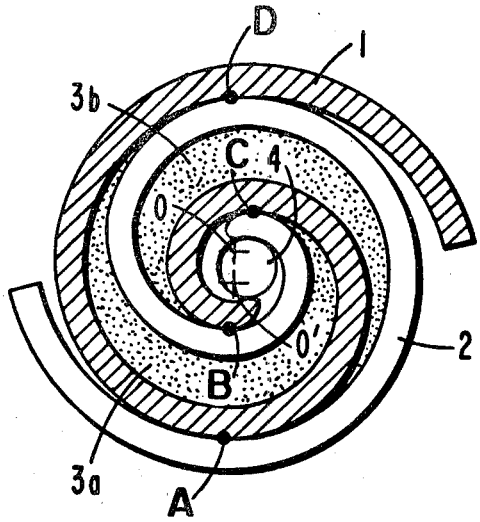
Figure 1C:
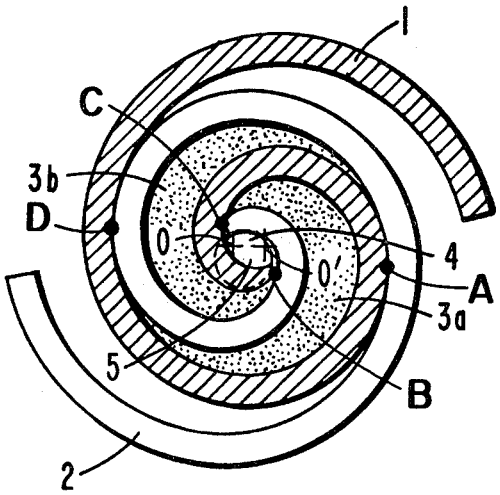
Figure 1D:
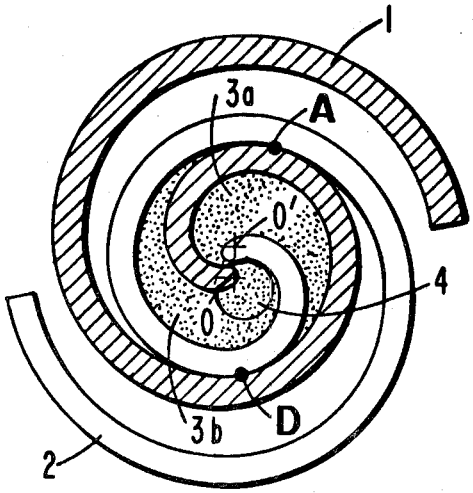

Now, the pair of fluid pockets 3*a* and 3*b* are connected to one another while passing the stage from FIG. 1*c* to FIG. 1*d*, and, as shown in FIG. 1*a*, both pockets 3*a* and 3*b* merge at the central portion 5 and are completely connected to one another to form a single pocket. The volume of the connected single pocket is further reduced by further revolutions of 90° as shown in FIGS. 1*b*, 1*c* and 1*d*, and is substantially zero in status of FIG. 1*d*. During the course of rotation, outer spaces which open in the state shown in FIG. 1*b* changes as shown in FIGS. 1*c*, 1*d* and 1*a* to form new sealed off pockets in which fluid is newly enclosed.

Accordingly, if circular end plates are disposed on and sealed to the axial facing ends of spiral elements 1 and 2, respectively, and if one of the end plates is provided with a discharge port 4 at the center thereof as shown in the figures, fluid is taken into the fluid pockets at the radial outer portions and is discharged from the discharge port 4 after compression.

In order to compress the fluid, it is important that each fluid pocket be sufficiently sealed.

In this invention, a seal element mounted in the axial end surface of each spiral element is urged towards the end plate by the pressure differential across the end surface of the spiral wrap to insure axial sealing.

Figure 2:
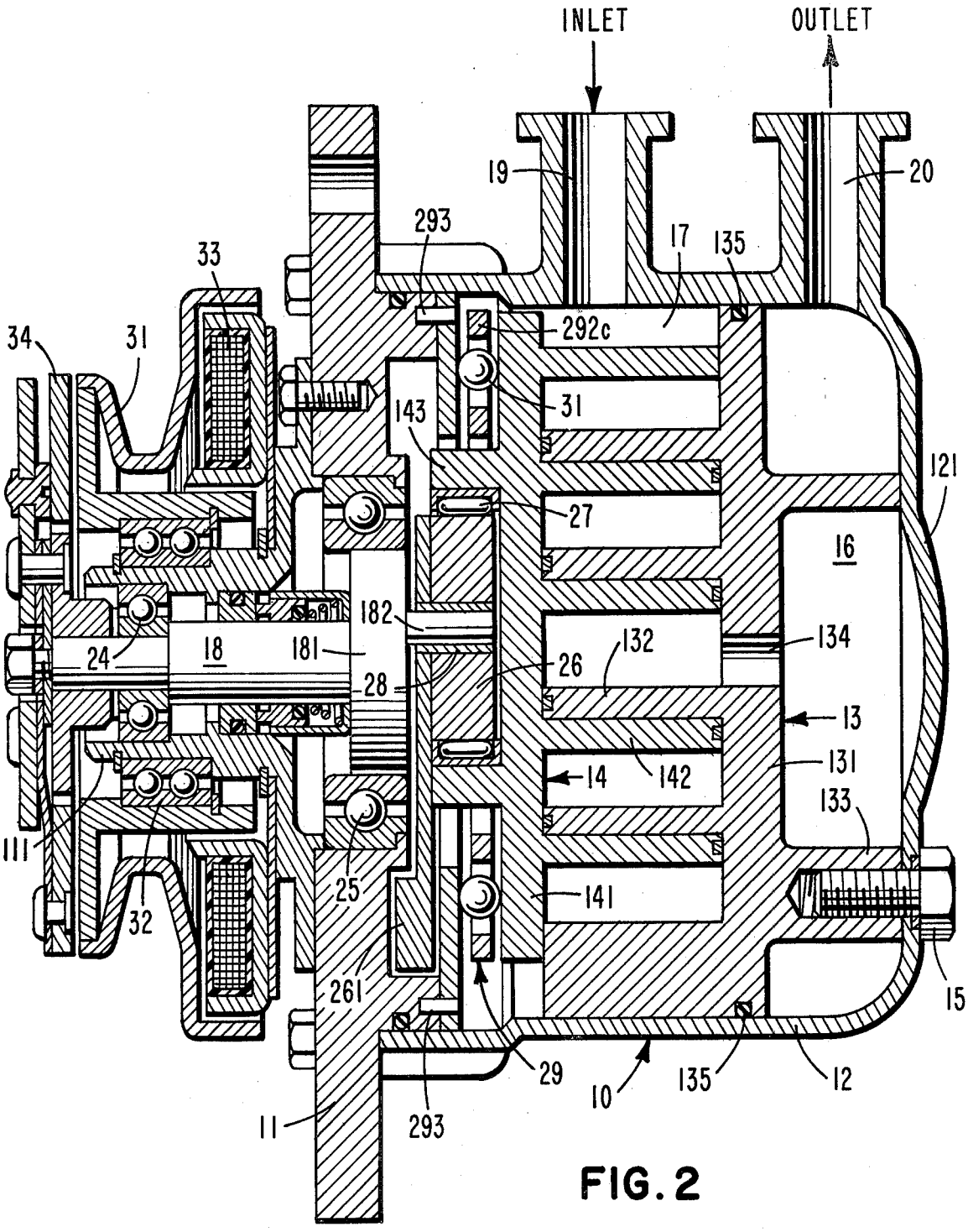
FIG. 2 is a vertical sectional view of a compressor unit in accordance of this invention.

Referring to FIG. 2, a compressor, such as a refrigerant compressor, is shown which includes a compressor housing 10 comprising a front end plate 11 and a cup-shaped casing 12 disposed on the end surface of the front end plate 11.

A fixed scroll member 13, an orbiting scroll member 14, and driving mechanism and a rotation preventing/-thrust bearing mechanism of orbiting scroll member 14 are disposed within an inner chamber of cup-shaped casing 12 which is formed between inner wall of cup-shaped casing 12 and end surface of front end plate 11.

Fixed scroll member 13 includes a circular end plate 131, a wrap or spiral element 132 affixed to or extending from one side surface of circular plate 131, and a plurality of internally threaded bosses 133 axially projecting from the end surface of plate 131 opposite to the side thereof from which spiral element 132 extends. The end surface of each boss 132 is seated on the inner surface of end plate portion 121 of cup-shaped casing 12 and is fixed to end plate portion 121 by a bolt 15. Hence, fixed scroll member 13 is fixedly disposed within cup-shaped casing 12. Circular plate 131 of fixed scroll member 13 partitions the inner chamber of cup-shaped casing 12 into discharge chamber 16 and suction chamber 17 by a seal ring 134 disposed between the outer peripheral surface of circular plate 131 and the inner wall of cup-shaped casing 12.

Orbiting scroll member 14 is disposed in sunction chamber 17 of the casing 12 and also comprises a circular end plate 141 and a wrap means or spiral element 142 affixed or extending from one side surface of circular plate 141. Spiral element 142 and spiral element 132 of fixed scroll member 13 interfit at angular offset of 180° and predetermined radial offset; therefore, a pair of fluid pockets are defined between spiral elements 132, 142. Orbiting scroll member 14 is connected to the driving mechanism and to the rotation preventing/-thrust bearing mechanism. These last two mechanisms effect orbital motion at circular radius Ro by rotation of drive shaft 18, which is rotatably supported by front end plate 11, to thereby compress the fluid, as described in connection with FIG. 1.

Figure 3:
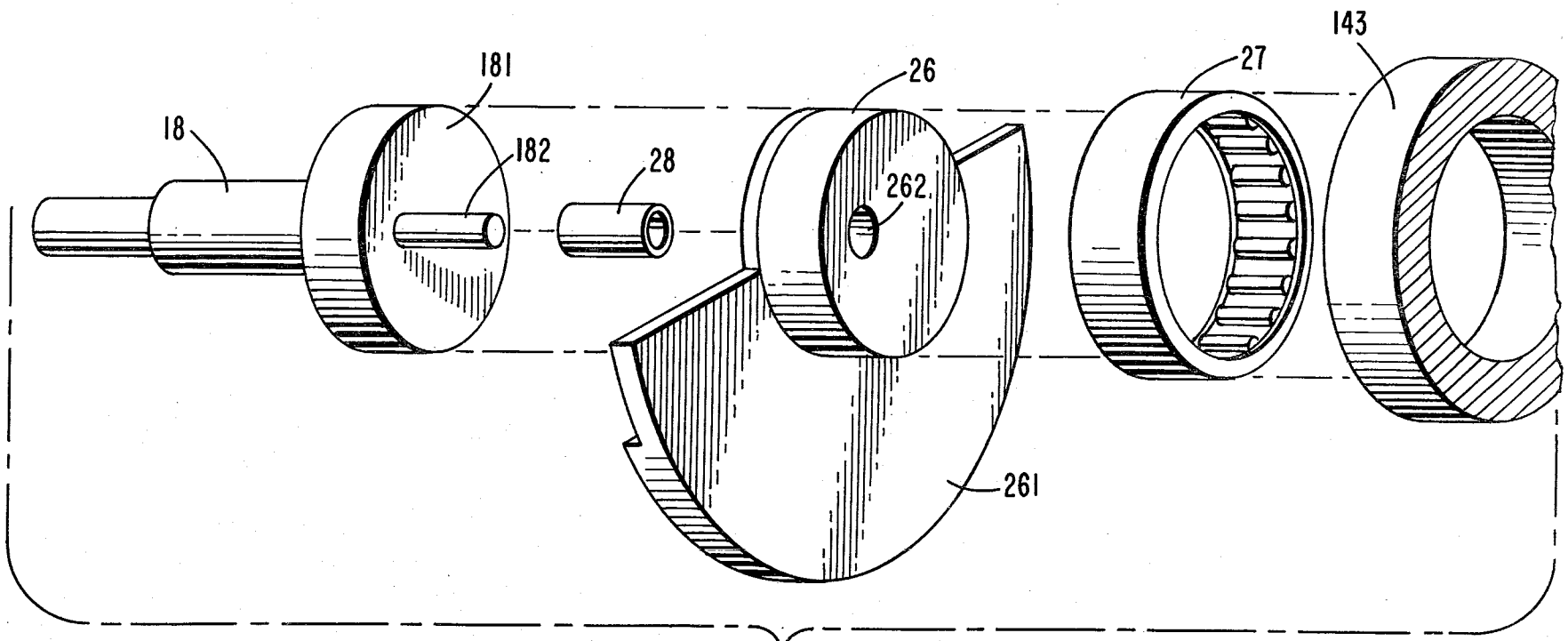
FIG. 3 is an exploded perspective view of the driving mechanism of the embodiment of FIG. 2.

Referring to FIG. 2 and FIG. 3, the driving mechanism of orbiting scroll member 14 will be described. Drive shaft 18 is rotatably supported by a sleeve portion 111 of front end plate 11, which projects from the front surface of front end plate 11, through a bearing 24. Drive shaft 18 has a disk portion 181 at its inner end portion. Disk portion 181 is also rotatably supported by front end plate 11 through a bearing 25 which is disposed within an opening of front end plate 11.

A crank pin or drive pin 182 axially projects from an end surface of disk portion 181 and is radially offset from the center of drive shaft 18. Circular plate 141 of orbiting scroll member 14 is provided with a tubular boss 143 axially projecting from an end surface opposite to the side thereof from which spiral element 142 extends. A discoid or short axial bushing 26 is fitted into boss 143 and is rotatably supported therein by a bearing means, such as a needle bearing 27. Bushing 26 has a balance weight 261 which is shaped as a portion of a disc or ring and extends radially from bushing 26 along a front surface thereof. An eccentric hole 262 is formed in bushing 26, radially offset from the center of bushing 26. Drive pin 182 is fitted into the eccentrically disposed hole 262 within which a bearing 28 may be applied. Bushing 26 is therefore driven by the revolution of drive pin 182 and permitted to rotate by needle bearing 27.

A pulley 31 is rotatably supported by a bearing 32. Bearing 32 is disposed on the outer surface of sleeve portion 111. An electromagnetic annular coil 33 is fixed to the outer surface of sleeve portion 111 and is received in an annular cavity of pulley 31. An armature plate 34 is elastically supported on the outer end of drive shaft 18 which extends from sleeve portion 111. A magnetic clutch comprising pulley 31, magnetic coil 33 and armature plate 34 is thereby formed. Thus, drive shaft 18 is driven by an external drive power source, for example, a motor of a vehicle, through a rotation force transmitting means, such as the magnetic clutch.

Now, the rotation of orbiting scroll member 14 is prevented by a rotation preventing/thrust bearing means 29 which is disposed between the inner surface of the housing 10 and circular plate 141 of the orbiting scroll member, whereby orbiting scroll member 14 orbits while maintaining its angular orientation relative to the fixed scroll member.

Figure 4:
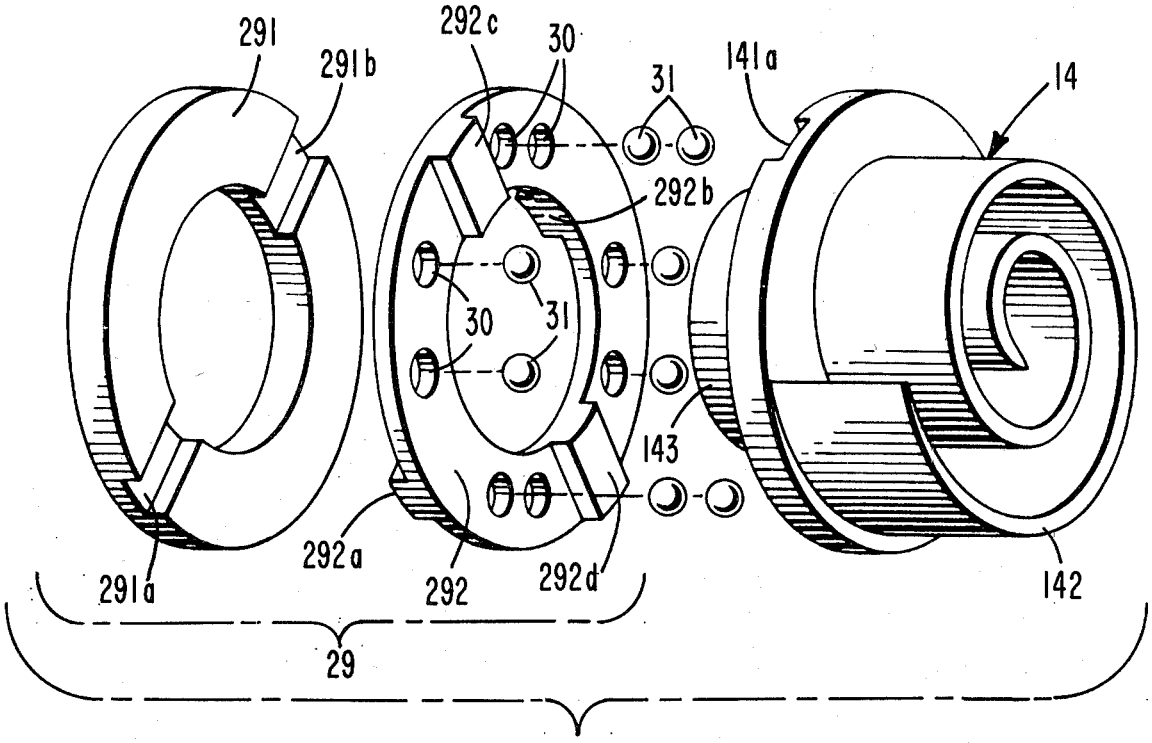
FIG. 4 is an exploded perspective view of the rotation preventing/thrust bearing mechanism of the embodiment of FIG. 2.

Referring to FIG. 4 and FIG. 1, rotation preventing/-thrust bearing means 29 will be described. Rotation preventing/thrust bearing means 29 is disposed to surround boss 143 and is comprised of a fixed ring 291 and a sliding ring 292. Fixed ring 291 is secured to an end surface of front end plate 11 by pins 293. Fixed ring 291 is provided with a pair of keyways **291*a*, 291*b* in an axial end surface facing orbiting scroll member 14. Sliding ring 292 is disposed in a hollow space between fixed ring 291 and circular plate 141 of orbiting scroll member 14. Sliding ring 292 is provided with a pair of keys 292*a*, 292*b* on the surface facing fixed ring 291, which are received in keyways 291*a*, 291*b*. Therefore, sliding ring 292 is slidable in the radial direction by the guide of keys 292*a*, 292*b* within keyways 291*a*, 291*b*. Sliding ring 292 is also provided with a pair of keys 292*c*, 292*d* on its opposite surface. Keys 292*c*, 292*d* are arranged along a diameter perpendicular to the diameter along which keys 292*a*, 292*b* are arranged. Circular plate 141 of orbiting scroll member 14 is provided with a pair of keyways (in FIG. 4 only one of keyways 141*a* is shown; the other keyway is disposed diametrically opposite to keyway 141*a*) on a surface facing sliding ring 292 in which are received keys 292*c*, 292*d*. Therefore, orbiting scroll member 14 is slidable in a radial direction by the guide of keys 292*c*, 292*d* within the keyways of circular plate 141**.

Accordingly, orbiting scroll member 14 is slidable in one radial direction with sliding ring 292, and is slidable in another radial direction independently. The second direction is perpendicular to the first direction. Therefore, orbiting scroll member 14 is prevented from rotating, but is permitted to move in two radial directions perpendicular to one another.

In addition, sliding ring 292 is provided with a plurality of pockets or holes 30 which are formed in an axial direction. A bearing means, such as balls 31, each having a diameter which is longer than the thickness of sliding ring 292, are retained in pockets 30. Balls 31 contact and roll on the surface of fixed ring 291 and circular plate 141. Therefore, the axial thrust load from orbiting scroll member 14 is supported on fixed ring 291 through bearing means 31.

Thus, when orbiting scroll member 14 is allowed to undergo the orbital motion of radius Ro by the rotation of drive shaft 18, fluid or refrigerant gas introduced into suction chamber 17 from an external fluid circuit through inlet port 19 on casing 12, is drawn into the fluid pockets formed between both spiral elements 132, 142. As orbiting scroll member 14 orbits, fluid in the fluid pockets is moved to the center of the spiral elements with a consequent reduction of volume thereof. Compressed fluid is discharged into discharge chamber 16 from the fluid pocket at the center of the spiral elements through a hole 134 which is formed through circular plate 131 at a position near to the center of spiral element 132 and therefrom is discharged through an outlet port 20 to an external fluid circuit, for example, a cooling circuit.

Figure 5:
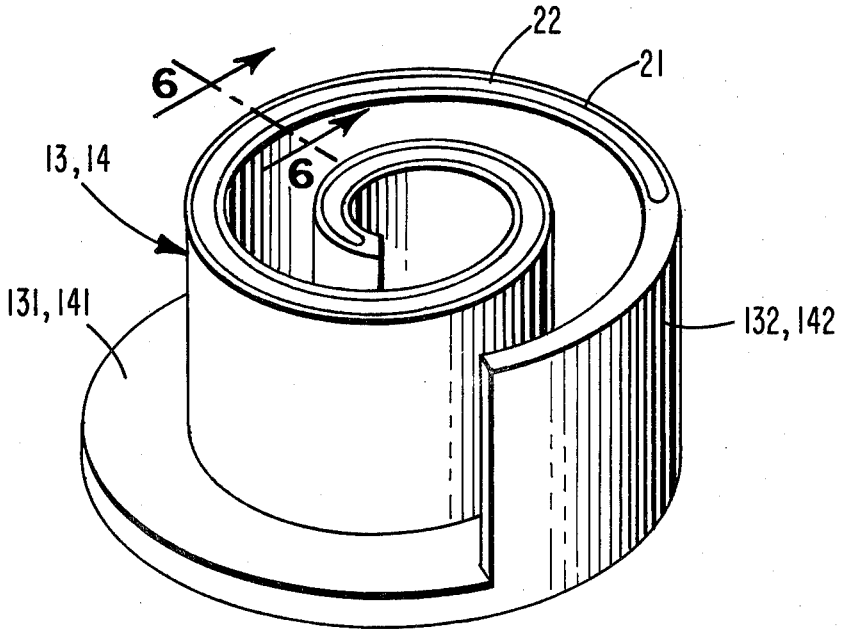
FIG. 5 is a perspective view of either scroll member according to this invention.

Referring to FIG. 5, each spiral element 132, 142 is provided with a groove 21 formed in its axial end surface along the spiral curve. Groove 21 extends from the inner end of the spiral element to a position close to the terminal end of the spiral element.

A seal element 22 is loosely fitted within groove 21. A hollow space remains between the groove and the seal element adjacent the bottom surface of groove 21, as shown in FIGS. 6–9. Thus, the hollow space is connected to adjacent fluid pockets which are formed between interfitting scroll members 13 and 14 by a gap between opposing circular plates and the axial end surfaces of the spiral elements 132, 142 and a gap between seal element 22 and the side walls of groove 21. Therefore, during operation the compressed fluid flows from adjacent fluid pockets into the hollow space to urge seal element 22 into contact with the opposite circular plate so that a seal between the spiral elements and the circular plate is effected.

Figure 6:
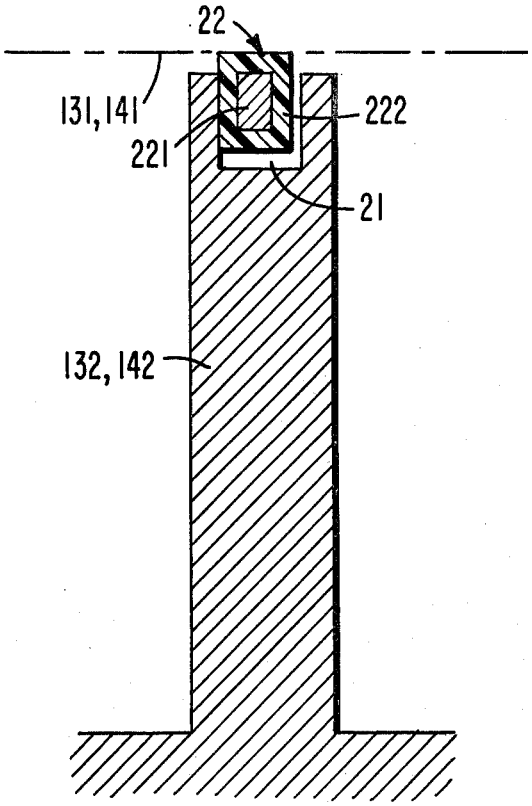
FIG. 6 is a sectional view taken along line 6—6 in FIG. 5 illustrating one embodiment of the invention.
Figure 7:
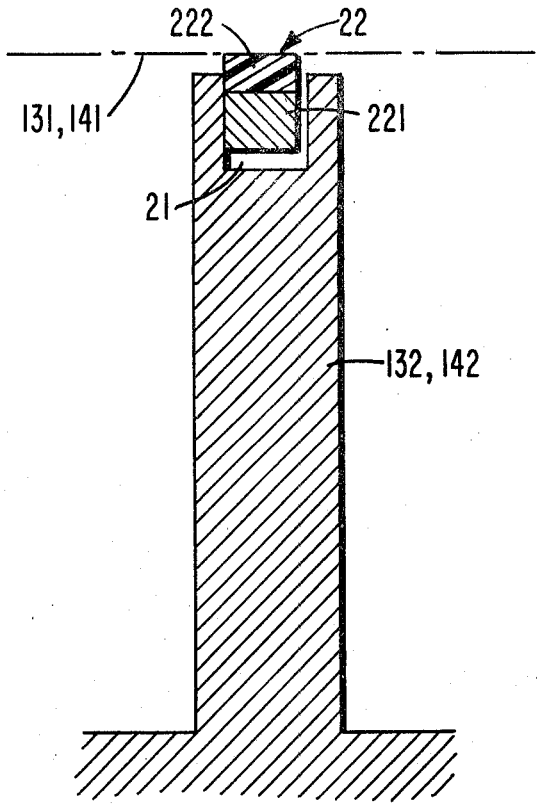
FIG. 7 is a sectional view similar to FIG. 6 of another embodiment.
Figure 8:
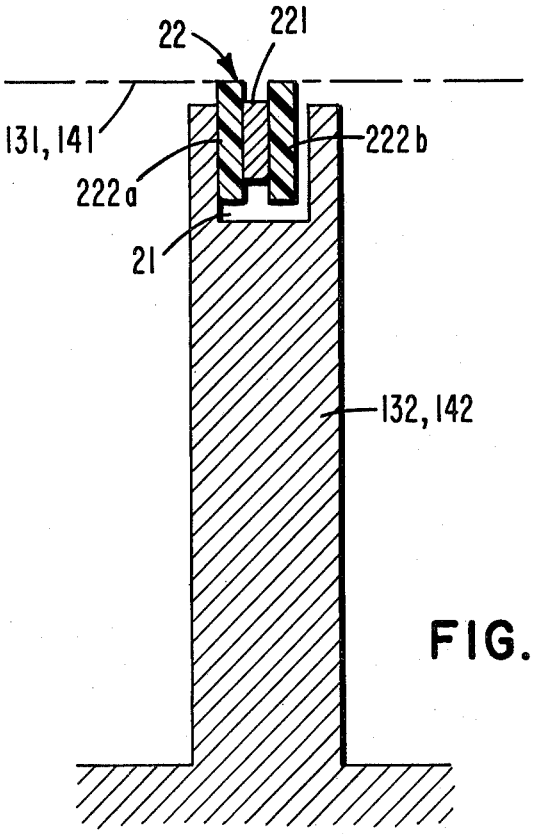
FIG. 8 is a sectional view similar to FIG. 6 of still another embodiment.
Figure 9:
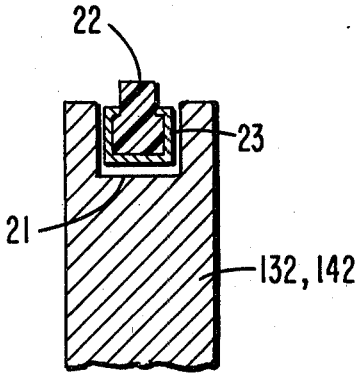
FIG. 9 is a sectional view similar to FIG. 6 of still another embodiment.

Seal element 22 disposed within groove 21 is provided with a reinforcement member to prevent the localized bending of seal element 22. Referring to FIGS. 6–8, one embodiment of seal element 22 having a core member as the reinforcement member will be described. Seal element 22 comprises a sliding member 222 which is formed of a material having a high sealing efficiency with low friction coefficient, such as PTFE, having a contact surface adapted to engage the opposite circular plate and a core member 221 which is formed of a metal having a substantial rigidity, such as steel. Core member 221 is inserted near the center of sliding member 222, as shown in FIG. 6. Therefore, when the high local fluid pressure acts against seal element 22, localized bending of seal element 22 is prevented to thereby prevent localized wear of the seal element.

In an alternative embodiment, sliding member 222 is affixed to the axial end surface of core member 221 so that the axial end surface of sliding member 222 contacts the opposite circular plate, as shown in FIG. 7. According to this construction of seal element 22, the production of the seal element is very easy and inexpensive, because the seal element is obtained by the following process. At first, the sliding member, such as a plate of PTFE resin is affixed to the surface of a plate of material for the core member. These bonded plates are then cut together in a spiral configuration by a punch or the like, so that the seal element is easily obtained.

In another embodiment, two sliding members 222*a* and 222*b* are affixed to the opposite side surfaces of core member 221 so that the axial end surface of core member 221 is recessed from the plate contacting surfaces of sliding member 222*a* and 222*b*, as shown in FIG. 8. According to this construction, the production of the seal element is very easy and inexpensive. First, two concentric tubes of plastic material for the sliding member are bonded to the outer and inner surfaces of a tube of steel for the core member. Then a cylindrical slice is cut from the composite tubular structure to form a ring. The exposed edge of the steel portion is etched to form a recess in the steel between the plastic portions. The ring is cut open so that it can be inserted into the spiral groove 21 in the spiral element.

FIGS. 9–12 illustrate other embodiments of the seal element wherein the seal element has a guide member as the reinforcement member. Seal element 22 is formed of a material which has a high sealing efficiency with low friction coefficient, such as PTFE resin, and is disposed within a channel-shaped guide member 23. The axial end surface of seal element 22 projects from the opening portion of guide members 23.

Figure 10:
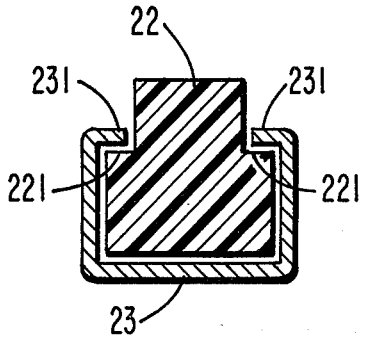
FIG. 10 is a sectional view of a seal element according to one embodiment of this invention.

Now, seal element 22 is formed with stepped portions or shoulders 221 near the axial end surface thereof (FIGS. 9, 10), and the edges of the opening of guide member 23 are inwardly bent at 231 for engagement with shoulders 221 of seal element 22, as shown in FIG. 10. Therefore, seal element 22 is securely held within guide member 23 without axial movement.

Figure 11:
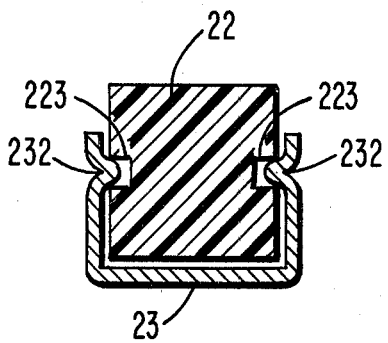
FIG. 11 is a sectional view similar to FIG. 10 of another embodiment.

FIG. 11 shows another embodiment of a seal element holding construction wherein indentations 223 are formed along both side surfaces of seal element 22 and inward projections 232 are formed on both side walls of guide member 23 for engaging the indentations 222. Therefore, seal element 22 is securely held within guide member 23 without axial movement.

According to these constructions, the seal element 22 is held within guide member 23 without axial movement. Therefore, when the fluid pressure acting to seal element partly changes, the localized bending of seal element 22 is prevented thereby reducing localized wear on seal element 22.

Figure 12:
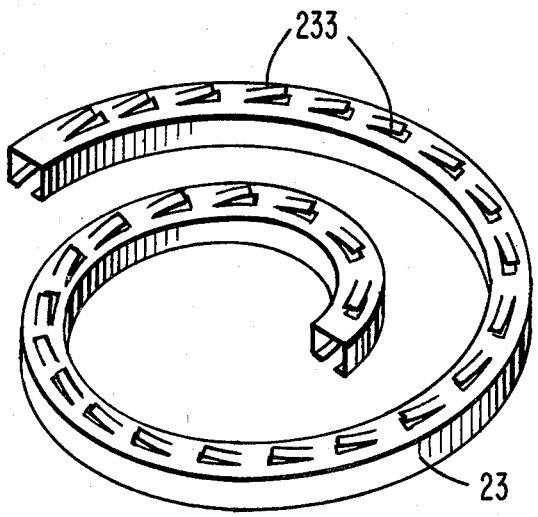
FIG. 12 is a perspective view of a guide member according to one embodiment of this invention.

Preferably, a plurality of projecting tongues are integrally formed or cut from the bottom portion of guide member 23, as shown in FIG. 12. The urging force acting to seal element 22 is in part due to the elasticity of tongues 233 and the fluid back pressure to thereby insure the axial sealing of the fluid pockets.

Especially at the outer portion of the spiral, sufficient sealing force cannot be expected due to a lower pressure differential across the spiral end surface. An axially urging force which does not depend upon the pressure differential is ideal for some applications. In these cases, the width of the groove is made substantially the same as that of the seal element to leave no radial clearance for fluid to enter the space formed between the groove bottom and the seal element.

This invention has been described in detail in connection with preferred embodiments, but these are merely for example only and the invention is not limited thereto. It will be easily understood by those skilled in the art that variations and modifications can be easily made within the scope of this invention, which is defined by the appended claims.

We claim:

1. In a scroll type fluid displacement apparatus including a pair of scroll members each comprising an end plate and a spiral wrap means extending from one surface of said end plate and provided with a groove which is formed in the axial end surface thereof along the spiral curve, both wrap means interfitting at an angular offset to make a plurality of line contacts to define at least one pair of sealed off fluid pockets, drive means operatively connected to one of said scroll members to cause said one scroll member to undergo orbital motion relative to the other scroll member, and prevent rotation of said one scroll member, whereby said fluid pockets change volume and pressure by the orbital motion of said one scroll member, and an elongated seal element disposed within each of said grooves of said wrap means and urged into contact with the adjacent end plate by the varying fluid pressure in the groove from the adjacent fluid pockets, and improvement comprising an elongated and substantially rigid reinforcement member secured to and supporting said seal element along substantially the entire length of said seal element for rigidifying said seal element to prevent localized bending thereof and effect uniform sealing.

2. The improvement as claimed in claim 1 wherein said sealing element comprises a sliding member adapted to engage the end plate of the opposite scroll member, and said reinforcement member comprises a core member affixed to said sliding member.

3. The improvement as claimed in claim 2 wherein said core member is inserted near the longitudinal center of said sliding member.

4. The improvement as claimed in claim 2 wherein said sliding member is affixed to the axial end surface of said core member.

5. The improvement as claimed in claim 2 wherein said sliding member comprises two separate portions affixed to opposite side surfaces of said core member.

6. The improvement as claimed in claim 2, 3, 4 or 5 wherein said sliding member is made of plastic.

7. The improvement as claimed in claim 6 wherein said plastic is PTFE.

8. The improvement as claimed in claim 7 wherein said core member is made of steel.

9. The improvement as claimed in claim 1 wherein said reinforcement member is a channel-shaped guide member which embraces said sealing element.

10. The improvement as claimed in claim 9 wherein said sealing element is made of plastic.

11. The improvement as claimed in claim 10 wherein said plastic is PTFE.

12. The improvement as claimed in claim 9 or 10 wherein said sealing element has a pair of stepped shoulders, and said guide member has inwardly facing flange portions for engaging said shoulders and firmly holding said sealing element to prevent axial movement thereof.

13. The improvement as claimed in claim 9 or 10 wherein said sealing element has an indentation on each side surface thereof, and said guide member has an inwardly projecting portion on booth side walls thereof which engage said indentations and firmly hold said sealing element to prevent axial movement thereof.

14. In a scroll type fluid displacement apparatus:

a housing having a fluid inlet port and a fluid outlet port;

a fixed scroll member fixedly disposed relative to said housing and having an end plate from which first spiral wrap means extends into the interior of said housing;

an orbiting scroll member having an end plate from which a second spiral wrap means extends, and said first and second wrap means interfitting at an angular and radial offset to make a plurality of line contacts to define at least one pair of sealed off fluid pockets;

driving means including a drive shaft rotatably supported by said housing and operatively connected to said orbiting scroll member to effect orbital motion of said orbiting scroll member and prevent rotation of said orbiting scroll member, whereby said fluid pockets change volume and pressure by the orbital motion of said orbiting scroll member;

a groove in the axial end surface of both of said wrap means along the spiral curve;

an elongated seal element disposed within each of said grooves and urged into contact with the adjacent end plate by the varying fluid pressure in the groove from the adjacent fluid pockets; and an elongated and substantially rigid reinforcement member secured to and supporting said seal element along substantially the entire length of said seal element for rigidifying said seal element to prevent localized bending thereof and effect uniform sealing.

15. The improvement as claimed in claim 14 wherein said seal element comprises a sliding member adapted to engage the end plate of the opposite scroll member, and said reinforcement member comprises a core member affixed to said sliding member.

16. The improvement as claimed in claim 15 wherein said sliding member is made of PTFE.

17. The improvement as claimed in claim 16 wherein said core member is made of steel.

18. The improvement as claimed in claim 14 wherein said reinforcement member is a channel-shaped guide member which embraces said sealing element.

19. The improvement as claimed in claim 9 or 18 wherein said guide member has springy protrusions on its bottom surface which contact the bottom of said groove and urge said sealing element into engagement with the end plate of the opposite scroll member.

* * * * *